US011565280B2

(12) United States Patent
Yomo et al.

(10) Patent No.: US 11,565,280 B2
(45) Date of Patent: Jan. 31, 2023

(54) METHOD OF APPLYING ELECTRON BEAM CURABLE AQUEOUS COATING MATERIAL

(71) Applicant: TOYOTA JIDOSHA KABUSHIKI KAISHA, Toyota (JP)

(72) Inventors: Shuji Yomo, Nagakute (JP); Kanji Mori, Nagakute (JP); Keiji Ambo, Miyoshi (JP); Mamoru Kouzaki, Miyoshi (JP); Atsuo Nabeshima, Okazaki (JP); Eiichi Okazaki, Takaoka (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/203,073

(22) Filed: Mar. 16, 2021

(65) Prior Publication Data

US 2021/0291223 A1 Sep. 23, 2021

(30) Foreign Application Priority Data

Mar. 17, 2020 (JP) ..... JP2020-046566

(51) Int. Cl.
*B05D 3/06* (2006.01)
*B05D 1/04* (2006.01)

(52) U.S. Cl.
CPC ..... *B05D 3/068* (2013.01); *B05D 1/04* (2013.01); *B05D 2502/005* (2013.01)

(58) Field of Classification Search
CPC ..... B05D 3/068
See application file for complete search history.

(56) References Cited

U.S. PATENT DOCUMENTS 4,593,051 A * 6/1986 Koleske ..... C08L 63/00 522/146
4,640,938 A * 2/1987 Romer ..... C08F 2/48 522/74

(Continued)

FOREIGN PATENT DOCUMENTS

JP 2011-084699 A 4/2011
JP 2011084699 A * 4/2011

(Continued)

OTHER PUBLICATIONS

The U.S. Appl. No. 17/129,099, filed Dec. 21, 2020 in the name of Eiichi Okazaki et al.

*Primary Examiner* — Cachet I Proctor
(74) *Attorney, Agent, or Firm* — Oliff PLC

(57) ABSTRACT

Provided is a method of applying an electron beam curable aqueous coating material, including coating a surface of a material to be coated with the electron beam curable aqueous coating material to form a wet coating film; drying the wet coating film until a time integration value of a reciprocal of an average value of viscosities of a region from a surface of the wet coating film to a depth of one half a film thickness of the wet coating film is in a range of 0.30 $(Pa\cdot s)^{-1}\cdot min$ to 0.90 $(Pa\cdot s)^{-1}\cdot min$, which is acquired by an electric field pick-up method, and a solid content concentration of the wet coating film is 90% by mass or greater; and curing the obtained dry coating film by irradiation with an electron beam after the wet coating film is dried.

7 Claims, 1 Drawing Sheet

(56) References Cited

U.S. PATENT DOCUMENTS

| | | | | | |
|---|---|---|---|---|---|
| 4,725,653 | A * | 2/1988 | Koleske | C08G 59/62 | 522/170 |
| 6,242,101 | B1 * | 6/2001 | Schwalm | C09D 4/00 | 522/174 |
| 6,472,028 | B1 * | 10/2002 | Frazzitta | B41F 7/32 | 427/504 |
| 2003/0148039 | A1 * | 8/2003 | Blum | B05D 3/067 | 427/551 |
| 2004/0033317 | A1 * | 2/2004 | Baudin | C07C 49/84 | 427/498 |
| 2006/0039939 | A1 * | 2/2006 | Lai | C08F 220/06 | 524/186 |
| 2014/0093727 | A1 * | 4/2014 | Richter | C09J 133/10 | 524/561 |

FOREIGN PATENT DOCUMENTS

| | | | | |
|---|---|---|---|---|
| JP | 2015-083136 | A | | 4/2015 |
| KR | 20000068835 | A | * | 11/2000 |

* cited by examiner

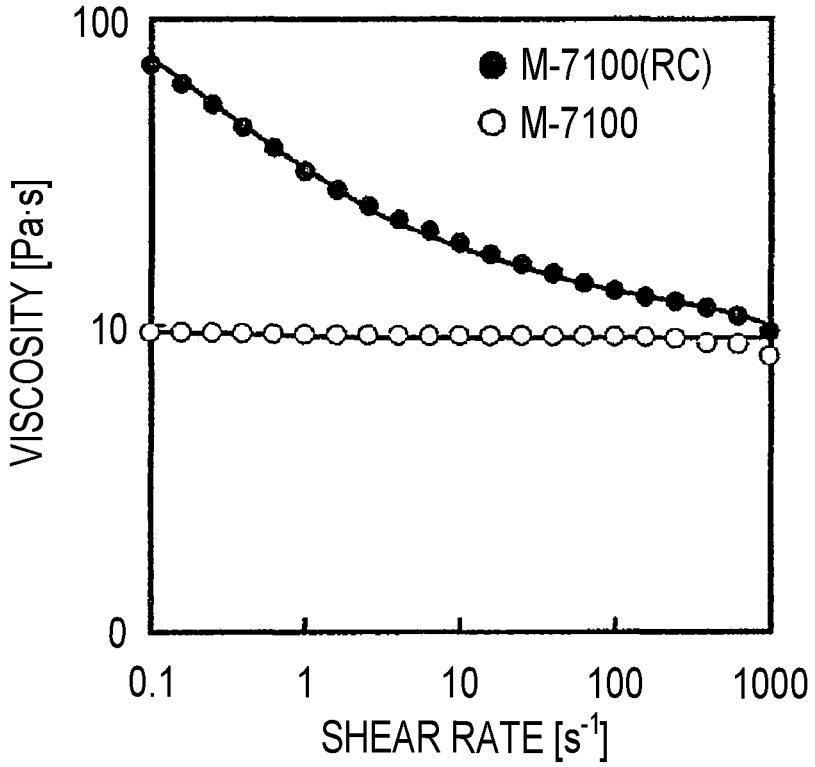
100
10
0
VISCOSITY [Pa·s]
M-7100(RC)
M-7100
0.1
1
10
100
1000
SHEAR RATE [s-1]

METHOD OF APPLYING ELECTRON BEAM CURABLE AQUEOUS COATING MATERIAL

CROSS-REFERENCE TO RELATED APPLICATION

This application claims priority to Japanese Patent Application No. 2020-046566 filed on Mar. 17, 2020 incorporated herein by reference in its entire.

BACKGROUND

1. Technical Field

The present disclosure relates to a method of applying an electron beam curable aqueous coating material.

2. Description of Related Art

An electron beam (EB) curing technology has advantages, such as energy saving, space saving, and reduction of the curing time, and is used for various applications, such as printing, coating, and bonding, and the range of use is expanding. Further, since EB has higher transparency than that of ultraviolet rays (UV), the EB curing technology is effective as means for curing an opaque coating film or a thick film coating film containing a pigment or the like.

Further, an electron beam curable coating material used for a coating method for which such an EB curing technology is used is not requested to be blended with a photopolymerization initiator, and thus the electron beam curable coating material has an advantage that the properties of a designed coating film-forming component are directly reflected in the properties of the coating film. Further, among such electron beam curable coating materials, an electron beam curable aqueous coating material uses water as a solvent, and thus is advantageous compared to a solvent type electron beam curable coating material in terms of environmental protection and safety during coating.

However, since water blended with the electron beam curable aqueous coating material as a solvent has lower volatility than that of an organic solvent, the water is likely to remain in a dry coating film even after a drying step is performed, and thus there is a problem in that particularly in a case where the dry coating film having a large amount of remaining water is cured by irradiation with electron beams, voids are formed inside the cured coating film.

Further, in order to obtain a cured coating film having a satisfactory appearance, it is necessary to smooth the surface of the coating film. As a method of improving the smoothness of the surface of a coating film, a method of lowering the surface layer viscosity of a wet coating film is known. However, there is a problem in that in a case where the surface layer viscosity of a wet coating film is lowered, sagging occurs when the wet coating film is dried.

Meanwhile, as a method of measuring the surface layer viscosity of the coating film during the formation of the coating film, a method carried out using an electric field pick-up method is known. For example, Japanese Unexamined Patent Application Publication No. 2011-84699 (JP 2011-84699 A) describes a method of forming a coating film on a material to be coated, including measuring the surface layer viscosity of the coating material according to an electric field pick-up method in the process of smoothing the surface in a state where the surface is coated with the coating material of the material to be coated and adjusting the viscosity such that the surface layer viscosity is a value greater than or equal to 500 mPa·s and less than or equal to 3100 mPa·s while the rate of the non-volatile content in the coating material is in a range of 90% by mass to 100% by mass, and also describes that the environmental temperature, the environmental humidity, the wind speed around the material to be coated, the air volume, and the heating temperature and the heating time for the material to be coated are requested to be adjusted in order to adjust the viscosity. However, the method described in JP 2011-84699 A can be applied to a method of applying a solvent coating material having a high evaporation rate of a volatile component, but the method is difficult to apply to an aqueous coating material that contains water having a low evaporation rate as a solvent.

SUMMARY

The present disclosure provides a method of applying an electron beam curable aqueous coating material, which enables the formation of a cured coating film in which occurrence of sagging during drying is suppressed and which has excellent surface smoothness.

As a result of intensive research repeatedly conducted by the present inventors, it was found that in a method of coating an electron beam curable aqueous coating material, a cured coating film in which occurrence of sagging during drying is suppressed and which has excellent surface smoothness can be formed by drying a wet coating film until a time integration value of a reciprocal of an average value of viscosities of a surface layer region of the wet coating film is in a predetermined range, which is acquired by an electric field pick-up method, and a solid content concentration of the wet coating film is in a predetermined range; and curing the obtained dry coating film by irradiation with electron beams after the wet coating film is dried, thereby completing the present disclosure.

That is, according to an aspect of the present disclosure, there is provided a method of applying an electron beam curable aqueous coating material, the method including: coating a surface of a material to be coated with the electron beam curable aqueous coating material to form a wet coating film; drying the wet coating film to obtain a dry coating film until a time integration value of a reciprocal of an average value of viscosities of a region from a surface of the wet coating film to a depth of one half a film thickness of the wet coating film is in a range of 0.30 $(Pa\cdot s)^{-1}\cdot min$ to 0.90 $(Pa\cdot s)^{-1}\cdot min$, which is acquired by an electric field pick-up method, and a solid content concentration of the wet coating film is 90% by mass or greater; and curing the obtained dry coating film by irradiation with an electron beam after the wet coating film is dried.

The average value of the viscosities of the region from the surface of the wet coating film before start of drying to the depth of one half the film thickness of the wet coating film, which is acquired by the electric field pick-up method, may be in a range of 10 Pa·s to 100 Pa·s.

Further, the method of applying an electron beam curable aqueous coating material may further include mixing a viscosity modifier with a coating film-forming component of the electron beam curable aqueous coating material before application of the electron beam curable aqueous coating material and adjusting a ratio ($\eta_{0.1}/\eta_{1000}$) between a viscosity ($\eta_{0.1}$) of a mixture of the coating film-forming component and the viscosity modifier at a shear rate of 0.1 $s^{-1}$ and a viscosity ($\eta_{1000}$) of the mixture at a shear rate of 1000 $s^{-1}$, which are measured at a temperature of 25° C., to 5 or greater.

Further, the coating film-forming component of the electron beam curable aqueous coating material may be an ethylenically unsaturated compound.

In the aspect of the present disclosure, the "wet coating film" indicates a coating film obtained by coating the surface of a material to be coated with the electron beam curable aqueous coating material until completion of drying, the "dry coating film" indicates a coating film from completion of drying to completion of irradiation with an electron beam, and the "cured coating film" indicates a coating film after completion of irradiation with an electron beam.

According to the aspect of the present disclosure, it is possible to form a cured coating film in which occurrence of sagging during drying is suppressed and which has excellent surface smoothness.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein:

FIG. 1 is a graph showing the shear rate dependence of the viscosities of polyester acrylate (M-7100) and polyester acrylate to which pseudoplasticity has been imparted (M-7100 (RC)).

DETAILED DESCRIPTION OF EMBODIMENTS

Hereinafter, preferred embodiments of the present disclosure will be described in detail.

A method of applying an electron beam curable aqueous coating material according to the embodiment of the present disclosure is a method including: coating a surface of a material to be coated with an electron beam curable aqueous coating material to form a wet coating film; drying the wet coating film to obtain a dry coating film until a time integration value of a reciprocal of an average value of viscosities of a region from a surface of the wet coating film to a depth of one half a film thickness of the wet coating film is in a range of 0.30 $(Pa\cdot s)^{-1}\cdot min$ to 0.90 $(Pa\cdot s)^{-1}\cdot min$, which is acquired by an electric field pick-up method, and a solid content concentration of the wet coating film is 90% by mass or greater; and curing the obtained dry coating film by irradiation with electron beams after the wet coating film is dried.

Electron Beam Curable Aqueous Coating Material

The electron beam curable aqueous coating material used in the present disclosure is not particularly limited as long as the material is an aqueous coating material that is cured by irradiation with electron beams. Examples of the coating film-forming component in such an electron beam curable aqueous coating material include an ethylenically unsaturated compound which is a compound cured by irradiation with electron beams, and both a water-soluble compound and a water-insoluble compound can be used. In a case where a water-insoluble compound is used as the ethylenically unsaturated compound, the compound can be used by being dispersed in water using a surfactant described below.

Examples of the ethylenically unsaturated compound include acrylic acid esters, methacrylic acid esters, vinyl esters, vinyl ethers, vinyl cyanides, styrenes, vinyl halides, vinylidene halides, maleic acid diesters, fumaric acid diesters, itaconic acid diesters, dialkylacrylamides, and heterocyclic vinyl compounds. Further, the ethylenically unsaturated compound may be an unmodified product or various modified products, such as a polyester modified product, an epoxy modified product, and a urethane modified product. The ethylenically unsaturated compounds may be used alone or in a combination of two or more kinds thereof.

Further, according to the embodiment of the present disclosure, as the ethylenically unsaturated compound, an appropriately synthesized product or a commercially available product (for example, polyester acrylate "ARONIX M-7100", urethane acrylate "ARONIX M-1200", special acrylate "ARONIX M-327", or special acrylate "ARONIX M-5700" (all manufactured by Toagosei Co., Ltd.)) may be used.

In the electron beam curable aqueous coating material used in the present disclosure, a non-aqueous viscosity modifier (rheology control agent) is previously mixed with the coating film-forming component before application, and a ratio ($\eta_{0.1}/\eta_{1000}$) of a viscosity ($\eta_{0.1}$) of the mixture of the coating film-forming component and the viscosity modifier at a shear rate of 0.1 $s^{-1}$ to a viscosity ($\eta_{1000}$) of the mixture at a shear rate of 1000 $s^{-1}$, which are measured at a temperature of 25° C., is adjusted to preferably 5 or greater and more preferably 7 or greater. In this manner, pseudoplasticity is imparted to the coating film-forming component, the pseudoplasticity is developed in the wet coating film during drying so that the viscosity of the wet coating film is increased, and thus occurrence of sagging during drying of the wet coating film can be sufficiently suppressed. The viscosity modifier is not particularly limited as long as the viscosity modifier can impart pseudoplasticity to the coating film-forming component, and examples of the viscosity modifier include commercially available viscosity modifiers, such as "BYK-415" and "BYK-430" (both manufactured by Big Chemie Japan Co., Ltd.). Further, the amount of such a viscosity modifier to be blended is not particularly limited as long as the amount is set such that the viscosity ratio ($\eta_{0.1}/\eta_{1000}$) reaches a predetermined value, but is preferably in a range of 0.5 parts by mass to 10 parts by mass and more preferably in a range of 1 part by mass to 3 parts by mass with respect to 100 parts by mass of the coating film-forming component.

Further, various additives, such as a surfactant, a thickener, a surface conditioner, a neutralizing agent, an antioxidant, an ultraviolet absorbing agent, an antifoaming agent, a coloring agent, and a bright pigment, may be optionally blended with the electron beam curable aqueous coating material used in the present disclosure. The amount of the additives to be blended is not particularly limited as long as the effects of the present disclosure are not impaired and can be appropriately set. For example, the surfactant is not particularly limited as long as the surfactant can uniformly disperse the coating film-forming component in water, and examples of the surfactant include commercially available surfactants, such as "NEWCOL 723" and "NEWCOL 740" (manufactured by Nippon Nyukazai Co., Ltd.). Further, the amount of such a surfactant to be blended is preferably in a range of 0.1 parts by mass to 10 parts by mass and more preferably in a range of 0.5 parts by mass to 5 parts by mass with respect to 100 parts by mass of the coating film-forming component.

Material to Be Coated

The material to be coated used in the present disclosure is not particularly limited as long as the material can form a cured coating film of the electron beam curable aqueous coating material on the surface of the material by irradiation with electron beams, and examples of the material include metal materials, such as iron, aluminum, brass, copper, tin, zinc, stainless steel, tin plate, galvanized steel, and alloyed galvanized steel (Zn—Al, Zn—Ni, or Zn—Fe); resins, such as a polyethylene resin, a polypropylene resin, an acrylonitrile-butadiene-styrene (ABS) resin, a polyamide resin, an acrylic resin, a vinylidene chloride resin, a polycarbonate resin, a polyurethane resin, and an epoxy resin; various plastic materials, such as FRP; inorganic materials, such as glass, cement, and concrete; wood, textile materials (such as paper and cloth), and foam. Among these, metal materials and plastic materials are preferable, and metal materials are particularly preferable. In particular, the present disclosure is suitably applied to steel sheets for automobiles, which have high requested characteristics for the appearance quality. The surfaces of the base materials may be previously subjected to treatments, such as electrodeposition coating or electrodeposition coating and intermediate coating.

Method of Applying Electron Beam Curable Aqueous Coating Material

The method of applying an electron beam curable aqueous coating material according to the embodiment of the present disclosure is a method including coating a surface of a material to be coated with an electron beam curable aqueous coating material to form a wet coating film; drying the wet coating film until a time integration value of a reciprocal of an average value of viscosities of a region from a surface of the wet coating film to the depth of one half the film thickness of the wet coating film is in a range of 0.30 $(Pa\cdot s)^{-1}\cdot min$ to 0.90 $(Pa\cdot s)^{-1}\cdot min$, which is acquired by an electric field pick-up method, and the solid content concentration of the wet coating film is 90% by mass or greater; and then curing the obtained dry coating film by irradiation with electron beams.

In the method of applying an electron beam curable aqueous coating material according to the embodiment of the present disclosure, first, the surface of the material to be coated is coated with the electron beam curable aqueous coating material to form a wet coating film. The method of applying the electron beam curable aqueous coating material is not particularly limited, and examples of the method include known methods, such as air spray coating, air electrostatic spray coating, and rotary atomization type electrostatic coating. The film thickness of the wet coating film is not particularly limited, but sagging is likely to occur in proportion to the film thickness of the wet coating film, and thus from the viewpoint of preventing the occurrence of such sagging, the film thickness is preferably in a range of 10 μm to 300 μm and more preferably in a range of 30 μm to 200 μm.

Next, the wet coating film formed in the above-described manner is dried until the time integration value of the reciprocal of the average value of viscosities of a region (hereinafter, also referred to as a "surface layer region") from the surface of the wet coating film to the depth of one half the film thickness of the wet coating film is in a range of 0.30 $(Pa\cdot s)^{-1}\cdot min$ to 0.90 $(Pa\cdot s)^{-1}\cdot min$ and the solid content concentration of the wet coating film is 90% by mass or greater. Further, the time integration value of the reciprocal of the average value of the viscosities of the surface layer region of the wet coating film is a value acquired by the following method.

That is, first, the deformation of the surface of the wet coating film is measured by irradiating the surface with laser light and acquiring the intensity of the laser light reflected on the surface of the wet coating film as the detecting voltage while the on and off of the direct current voltage is switched, using an electric field pick-up viscometer. The time constant at each measurement time is acquired based on the obtained time-voltage waveform, and the viscosity of the surface layer region of the wet coating film at each measurement time is further acquired. Here, by setting the distance between the electrode needle of the electric field pick-up viscometer and the surface of the wet coating film as the distance from the surface of the wet coating film to the depth of one half the film thickness of the wet coating film, the viscosity of the surface layer region of the obtained wet coating film is an average value $\eta$ (unit: Pa·s) of the viscosities of the region from the surface of the wet coating film to the depth of one half the film thickness of the wet coating film. Next, a reciprocal $1/\eta$ (unit: $(Pa\cdot s)^{-1}$) of the average value of the viscosities of the surface layer region of the wet coating film at each measurement time is acquired based on the average value $\eta$ of the viscosities of the surface layer region of the wet coating film at each measurement time, and a time integration value $\int(1/\eta)dt$ (unit: $(Pa\cdot s)^{-1}\cdot min$) of the reciprocal of the average value of the viscosities of the surface layer region of the wet coating film at each measurement time is further acquired based on the reciprocal $1/\eta$ of the average value of the viscosities of the surface layer region of the wet coating film at each measurement time.

In a case where the time integration value of the reciprocal of the average value of the viscosities of the surface layer region of the wet coating film is less than 0.30 $(Pa\cdot s)^{-1}\cdot min$, the obtained cured coating film has degraded surface smoothness. In addition, in a case where the time integration value of the reciprocal of the average value of the viscosities of the surface layer region of the wet coating film is greater than 0.90 $(Pa\cdot s)^{-1}\cdot min$, sagging occurs during drying of the wet coating film, and thus the obtained cured coating film also has degraded surface smoothness. Further, from the viewpoint of sufficiently suppressing the occurrence of sagging during drying of the wet coating film and improving the surface smoothness of the obtained cured coating film, the time integration value of the reciprocal of the average value of the viscosities of the surface layer region of the wet coating film is preferably in a range of 0.5 $(Pa\cdot s)^{-1}\cdot min$ to 0.9 $(Pa\cdot s)^{-1}\cdot min$ and more preferably in a range of 0.6 $(Pa\cdot s)^{-1}\cdot min$ to 0.9 $(Pa\cdot s)^{-1}\cdot min$. Further, in a case where the solid content concentration of the wet coating film is less than 90% by mass, a large amount of volatile components (particularly water) remain in the obtained dry coating film, and the obtained cured coating film is a sponge-like state.

In the method of applying the electron beam curable aqueous coating material according to the embodiment of the present disclosure, the conditions for drying the wet coating film are not particularly limited as long as the drying conditions are set such that the time integration value of the reciprocal of the average value of the viscosities of the surface layer region of the wet coating film and the solid content concentration of the wet coating film are respectively in a predetermined range, and can be appropriately set. The drying temperature and the drying time can be set such that the time integration value of the reciprocal of the average value of the viscosities of the surface layer region of the wet coating film and the solid content concentration of the wet coating film are respectively in a predetermined range, for example, within a drying temperature range of 25° C. to 100° C. (more preferably 40° C. to 90° C.) and a drying time range of 1 minute to 30 minutes (more preferably 2 minutes to 10 minutes).

Further, in the method of applying the electron beam curable aqueous coating material according to the embodiment of the present disclosure, the average value of the viscosities of the surface layer region of the wet coating film before the start of drying (particularly immediately before the start of drying) is preferably in a range of 10 Pa·s to 100 Pa·s. In a case where the average value of the viscosities of the surface layer region of the wet coating film before the start of drying is less than the lower limit or greater than the upper limit, sagging is likely to occur during the drying of the wet coating film, and the obtained cured coating film is likely to have degraded surface smoothness. Further, the time integration value of the reciprocal of the average value of the viscosities of the surface layer region of the wet coating film is a value acquired by the above-described method.

Next, a cured coating film in which the occurrence of sagging during drying is suppressed and which has excellent surface smoothness is obtained by irradiating the dry coating film obtained in the above-described manner with an electron beam to cure the dry coating film. The method of irradiating the dry coating film with electron beams is not particularly limited, and examples of the method include a method using a known electron beam irradiation device.

The conditions for irradiating the film with electron beams are not particularly limited as long as the electron beam curable aqueous coating material is cured, and for example, the acceleration voltage is preferably in a range of 10 kV to 400 kV and more preferably in a range of 80 kV to 300 kV, and the irradiation dose is preferably in a range of 5 kGy to 5000 kGy and more preferably in a range of 10 kGy to 1000 kGy.

Hereinafter, the present disclosure will be described in more detail based on examples and comparative examples, but the present disclosure is not limited to the following examples. Further, methods of preparing aqueous coating materials used in the examples and the comparative examples and methods of measuring the physical properties are described below.

Volatile Content Concentration of Aqueous Coating Material

A stainless steel plate was coated with an aqueous coating material using an air spray coating machine such that the film thickness of the wet coating film reached 100 μm, and a mass $W_{wet}$ (unit: g) of the obtained wet coating film was measured. Next, the wet coating film was dried at 80° C. for 3 minutes and cured by being irradiated with electron beams for 0.4 seconds under the conditions of an acceleration voltage of 150 kV and an irradiation dose of 30 kGy. A mass $W_{cure}$ (unit: g) of the obtained cured coating film was measured, and a volatile content concentration NV (unit: % by mass) of the aqueous coating material was calculated based on the following equation.

$$NV=(W_{wet}-W_{cure})/W_{wet}\times 100$$

Viscosity of Aqueous Coating Material

The viscosity of the aqueous coating material was measured using a dynamic viscoelasticity measuring device ("ARES-G2", manufactured by TA Instruments, cone plate diameter: 25 mm, cone angle: 0.04°) under the conditions of a temperature of 25° C. and a shear rate of 0.1 $s^{-1}$.

Preparation Example 1

First, 2 parts by mass of a viscosity modifier ("BYK-415" manufactured by Big Chemie Japan Co., Ltd.) was added to 98 parts by mass of polyester acrylate ("ARONIX M-7100" manufactured by Toagosei Co., Ltd., hereinafter, the polyester acrylate is referred to as "polyester acrylate (M-7100)") serving as a coating film-forming component to impart pseudoplasticity. Hereinafter, the polyester acrylate to which the pseudoplasticity is imparted will be referred to as "pseudoplastic acrylate (M-7100 (RC))".

50 parts by mass of the pseudoplastic acrylate (M-7100 (RC)) (concentration of viscosity modifier: 2% by mass) was dispersed in a mixed aqueous solution containing 45 parts by mass of ion exchange water, 1 part by mass of a nonionic surfactant ("NEWCOL 740" manufactured by Nippon Nyukazai Co., Ltd.), and 5 parts by mass of butyl cellosolve using a homogenizer. 2 parts by mass of a thickener ("BONKOTE HV-E", manufactured by DIC Corporation), 1 part by mass of a surface conditioner ("BYK-346" manufactured by Big Chemie Japan Co., Ltd.), and 0.5 parts by mass of dimethylaminoethanol serving as a neutralizing agent were added to the obtained dispersion liquid, thereby preparing an aqueous coating material 1. The volatile content concentration and the viscosity (temperature: 25° C., shear rate: 0.1 $s^{-1}$) of the aqueous coating material 1 are listed in Table 1.

Preparation Example 2

An aqueous coating material 2 was prepared in the same manner as in Preparation Example 1 except that the amount of ion exchange water was changed to 40 parts by mass and a mixed aqueous solution further containing 5 parts by mass of isopropyl alcohol was used. The volatile content concentration and the viscosity (temperature: 25° C., shear rate: 0.1 $s^{-1}$) of the aqueous coating material 2 are listed in Table 1.

Preparation Example 3

An aqueous coating material 3 was prepared in the same manner as in Preparation Example 1 except that the amount of ion exchange water was changed to 42 parts by mass and the amount of butyl cellosolve was changed to 8 parts by mass. The volatile content concentration and the viscosity (temperature: 25° C., shear rate: 0.1 $s^{-1}$) of the aqueous coating material 3 are listed in Table 1.

Preparation Example 4

An aqueous coating material 4 was prepared in the same manner as in Preparation Example 1 except that 50 parts by mass of polyester acrylate (M-7100) was used in place of pseudoplastic acrylate (M-7100 (RC)), the amount of ion exchange water was changed to 50 parts by mass, and butyl cellosolve was not used. The volatile content concentration and the viscosity (temperature: 25° C., shear rate: 0.1 $s^{-1}$) of the aqueous coating material 4 are listed in Table 1.

Preparation Example 5

An aqueous coating material 5 was prepared in the same manner as in Preparation Example 1 except that 50 parts by mass of polyester acrylate (M-7100) was used in place of pseudoplastic acrylate (M-7100 (RC)) and 5 parts by mass of isopropyl alcohol was used in place of butyl cellosolve. The volatile content concentration and the viscosity (temperature: 25° C., shear rate: 0.1 $s^{-1}$) of the aqueous coating material 5 are listed in Table 1.

Preparation Example 6

An aqueous coating material 6 was prepared in the same manner as in Preparation Example 1 except that 50 parts by mass of polyester acrylate (M-7100) was used in place of pseudoplastic acrylate (M-7100 (RC)), the amount of ion exchange water was changed to 50 parts by mass, the amount of the thickener was changed to 5 parts by mass, the amount of the neutralizing agent was changed to 1.2 parts by mass, and butyl cellosolve was not used. The volatile content concentration and the viscosity (temperature: 25° C., shear rate: 0.1 $s^{-1}$) of the aqueous coating material 6 are listed in Table 1.

Preparation Example 7

An aqueous coating material 7 was prepared in the same manner as in Preparation Example 1 except that the amount of ion exchange water was changed to 50 parts by mass and butyl cellosolve was not used. The volatile content concentration and the viscosity (temperature: 25° C., shear rate: 0.1 $s^{-1}$) of the aqueous coating material 7 are listed in Table 1.

TABLE 1

| | | Preparation Example 1 Aqueous coating material 1 | Preparation Example 2 Aqueous coating material 2 | Preparation Example 3 Aqueous coating material 3 | Preparation Example 4 Aqueous coating material 4 | Preparation Example 5 Aqueous coating material 5 | Preparation Example 6 Aqueous coating material 6 | Preparation Example 7 Aqueous coating material 7 |
|---|---|---|---|---|---|---|---|---|
| Acrylate | M-7100(RC) | 50 | 50 | 50 | — | — | — | 50 |
| | M-7100 | — | — | — | 50 | 50 | 50 | — |
| Ion exchange water | | 45 | 40 | 42 | 50 | 45 | 50 | 50 |
| Nonionic surfactant | NEWCOL 740 | 1 | 1 | 1 | 1 | 1 | 1 | 1 |
| Organic solvent | Butyl cellosolve | 5 | 5 | 8 | — | — | — | — |
| | Isopropyl alcohol | — | 5 | — | — | 5 | — | — |
| Thickener | BONKOTE HV-E | 2 | 2 | 2 | 2 | 2 | 5 | 2 |
| Surface conditioner | BYK-346 | 1 | 1 | 1 | 1 | 1 | 1 | 1 |
| Neutralizing agent | Dimethylaminoethanol | 0.5 | 0.5 | 0.5 | 0.5 | 0.5 | 1.2 | 0.5 |
| Volatile content concentration | [% by mass] | 50 | 50 | 50 | 50 | 50 | 50 | 50 |
| Viscosity | [Pa s] | 13.2 | 15.7 | 12.5 | 8.5 | 8.5 | 121.3 | 40.3 |

(Unit: parts by mass)

Example A-1

Time Integration Value of Reciprocal of Average Value of Viscosities of Surface Layer Region First, a change in time of the average value of the viscosities of the surface layer region in the step of drying the wet coating film was acquired. Specifically, a stainless steel plate was coated with the aqueous coating material 1 obtained in Preparation Example 1 using an air spray coating machine such that the film thickness of the wet coating film reached 100 μm. The obtained wet coating film was rapidly held at 25° C. for 10 minutes and then heated to 80° C. for 3 minutes. During this time, the deformation of the surface of the wet coating film was measured by irradiating the surface with laser light, acquiring the intensity of the laser light reflected on the surface of the wet coating film as the detecting voltage, and setting a measurement pitch of 0.01 seconds while the on and off of the direct current voltage was switched, using an electric field pick-up viscometer (RM-01T, manufactured by Kyoto Electronics Manufacturing Co., Ltd.) under the measurement condition that the distance between an electrode needle and the surface of the wet coating film was set to 50 μm, the voltage was set to 5 V, the voltage on time was set to 1.0 seconds, and the voltage off time was set to 1.0 seconds. The time constant at each measurement time was acquired based on the obtained time-voltage waveform, and the viscosity of the surface layer region of the wet coating film at each measurement time was further acquired. The results are listed in Table 2.

Further, since the distance between the electrode needle and the surface of the wet coating film (50 μm) is one half of the film thickness of the wet coating film (100 μm), the obtained viscosity is the average value η (unit: Pa·s) of the viscosities of the region from the surface of the wet coating film to the depth of one half the film thickness of the wet coating film (the surface layer region).

Next, the reciprocal 1/η (unit: $(Pa\cdot s)^{-1}$) of the average value of the viscosities of the surface layer region of the wet coating film at each measurement time was acquired based on the results listed in Table 2. The results are listed in Table 3. Further, the time integration value ∫(1/η)dt (unit: $(Pa\cdot s)^{-1}\cdot min$) of the reciprocal of the average value of the viscosities of the surface layer region of the wet coating film at each measurement time was acquired based on the results listed in Table 3. The results are listed in Table 4.

Solid Content Concentration

A stainless steel plate was coated with the aqueous coating material 1 obtained in Preparation Example 1 using an air spray coating machine such that the film thickness of the wet coating film reached 100 and the obtained wet coating film was rapidly held at 25° C. for 10 minutes and then heated to 80° C. for 3 minutes. During this time, the mass $W_t$ (unit: g) of the wet coating film at each measurement time was measured, and the solid content concentration $C_t$ (unit: % by mass) of the wet coating film at each measurement time was acquired based on the following equation.

$$C_t=(C_{ini}\times W_{ini})/W_t\times 100$$

[In the equation, $C_{ini}$ represents the solid content concentration (unit: % by mass) of the aqueous coating material, and $W_{ini}$ represents the coating amount (unit: g) of the aqueous coating material.]

The results are listed in Table 5.

Coating

An electrodeposition coating plate was coated with the aqueous coating material 1 obtained in Preparation Example 1 using an air spray coating machine such that the film thickness of the wet coating film reached 100 and the obtained wet coating film was rapidly set in a vertical state in an atmosphere of 25° C. and 70% RH for 10 minutes, heated to 80° C. for 3 minutes in the vertical state, and dried. Further, the drying conditions were set based on the results listed in Tables 4 and 5. The obtained dry coating film was visually observed to confirm the presence or absence of sagging. The results are listed in Table 6.

Next, the dry coating film was irradiated with an electron beam for 1 second under the conditions of an acceleration voltage of 150 kV and an irradiation dose of 80 KGy so that the dry coating film was cured. The wave scan value (Wd: wavelength of 3 to 10 mm) of the obtained cured coating film was measured using a wave scan ("Wave-ScanDual", manufactured by BYK-Gardner, Inc.). The results are listed in Table 6.

Example A-2

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the aqueous coating material 2 obtained in Preparation Example 2 was used in place of the aqueous coating material 1. The results are listed in Tables 2 to 5.

Further, the cured coating film was prepared on an electrodeposition coating plate, the sagging property of the obtained cured coating film was confirmed, and the wave scan value (Wd) of the cured coating film was measured in the same manner as in Example A-1 except that the aqueous coating material 2 obtained in Preparation Example 2 was used in place of the aqueous coating material 1. The results are listed in Table 6.

Example A-3

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the aqueous coating material 3 obtained in Preparation Example 3 was used in place of the aqueous coating material 1. The results are listed in Tables 2 to 5.

Further, the cured coating film was prepared on an electrodeposition coating plate, the sagging property of the obtained cured coating film was confirmed, and the wave scan value (Wd) of the cured coating film was measured in the same manner as in Example A-1 except that the aqueous coating material 3 obtained in Preparation Example 3 was used in place of the aqueous coating material 1. The results are listed in Table 6.

Comparative Example A-1

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the aqueous coating material 4 obtained in Preparation Example 4 was used in place of the aqueous coating material 1. The results are listed in Tables 2 to 5.

Further, the cured coating film was prepared on an electrodeposition coating plate, the sagging property of the obtained cured coating film was confirmed, and the wave scan value (Wd) of the cured coating film was measured in the same manner as in Example A-1 except that the aqueous coating material 4 obtained in Preparation Example 4 was used in place of the aqueous coating material 1. The results are listed in Table 6.

Comparative Example A-2

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the aqueous coating material 5 obtained in Preparation Example 5 was used in place of the aqueous coating material 1. The results are listed in Tables 2 to 5.

Further, the cured coating film was prepared on an electrodeposition coating plate, the sagging property of the obtained cured coating film was confirmed, and the wave scan value (Wd) of the cured coating film was measured in the same manner as in Example A-1 except that the aqueous coating material 5 obtained in Preparation Example 5 was used in place of the aqueous coating material 1. The results are listed in Table 6.

Comparative Example A-3

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the aqueous coating material 6 obtained in Preparation Example 6 was used in place of the aqueous coating material 1. The results are listed in Tables 2 to 5.

Further, the cured coating film was prepared on an electrodeposition coating plate, the sagging property of the obtained cured coating film was confirmed, and the wave scan value (Wd) of the cured coating film was measured in the same manner as in Example A-1 except that the aqueous coating material 6 obtained in Preparation Example 6 was used in place of the aqueous coating material 1. The results are listed in Table 6.

Comparative Example A-4

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the aqueous coating material 7 obtained in Preparation Example 7 was used in place of the aqueous coating material 1. The results are listed in Tables 2 to 5.

Further, the cured coating film was prepared on an electrodeposition coating plate, the sagging property of the obtained cured coating film was confirmed, and the wave scan value (Wd) of the cured coating film was measured in the same manner as in Example A-1 except that the aqueous coating material 7 obtained in Preparation Example 7 was used in place of the aqueous coating material 1. The results are listed in Table 6.

Comparative Example A-5

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the aqueous coating material 3 obtained in Preparation Example 3 was used in place of the aqueous coating material 1, and the obtained wet coating film was rapidly held at 25° C. for 10 minutes after the application of the aqueous coating material 3, heated to 80° C. for 3 minutes, and further heated at 80° C. for 7 minutes. The results are listed in Tables 2 to 5.

Further, the cured coating film was prepared on an electrodeposition coating plate, the sagging property of the obtained cured coating film was confirmed, and the wave scan value (Wd) of the cured coating film was measured in the same manner as in Example A-1 except that the aqueous coating material 3 obtained in Preparation Example 3 was used in place of the aqueous coating material 1, and the obtained wet coating film was rapidly held at 25° C. for 10 minutes after the application of the aqueous coating material 3, heated to 80° C. for 3 minutes, and further heated at 80° C. for 7 minutes. The results are listed in Table 6.

Comparative Example A-6

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the aqueous coating material 3 obtained in Preparation Example 3 was used in place of the aqueous coating material 1, and the obtained wet coating film was rapidly held at 25° C. for 10 minutes after the application of the aqueous coating material 3 and was not heated to 80° C. The results are listed in Tables 2 to 5.

Further, the cured coating film was prepared on an electrodeposition coating plate, the sagging property of the obtained cured coating film was confirmed, and the wave scan value (Wd) of the cured coating film was measured in the same manner as in Example A-1 except that the aqueous coating material 3 obtained in Preparation Example 3 was used in place of the aqueous coating material 1, and the obtained wet coating film was rapidly held at 25° C. for 10 minutes after the application of the aqueous coating material 3 and was not heated to 80° C. The results are listed in Table 6.

TABLE 2

| | | Average value of viscosities [Pa · s] | | | | | | | | |
|---|---|---|---|---|---|---|---|---|---|---|
| Time [min] | Temperature [° C.] | Example A-1 Aqueous coating material 1 | Example A-2 Aqueous coating material 2 | Example A-3 Aqueous coating material 3 | Comparative Example A-1 Aqueous coating material 4 | Comparative Example A-2 Aqueous coating material 5 | Comparative Example A-3 Aqueous coating material 6 | Comparative Example A-4 Aqueous coating material 7 | Comparative Example A-5 Aqueous coating material 3 | Comparative Example A-6 Aqueous coating material 3 |
| 0 | 25 | 13.2 | 15.7 | 12.5 | 8.5 | 8.5 | 121.3 | 40.3 | 12.6 | 12.5 |
| 2 | 25 | 23.0 | 23.0 | 14.2 | 8.6 | 8.5 | 56.1 | 43.6 | 14.2 | 14.3 |
| 5 | 25 | 28.1 | 17.7 | 22.3 | 15.3 | 14.9 | 23.0 | 40.3 | 22.2 | 22.3 |
| 10 | 25 | 48.3 | 26.1 | 13.4 | 17.0 | 15.7 | 13.9 | 58.5 | 13.4 | 13.5 |
| 13 | 80 | 29.3 | 29.8 | 10.8 | 3.7 | 3.1 | 3.7 | 51.7 | 10.8 | — |
| 20 | 80 | — | — | — | — | — | — | — | 12.1 | — |

TABLE 3

| | | Reciprocal of average value of viscosities [$(Pa \cdot s)^{-1}$] | | | | | | | | |
|---|---|---|---|---|---|---|---|---|---|---|
| Time [min] | Temperature [° C.] | Example A-1 Aqueous coating material 1 | Example A-2 Aqueous coating material 2 | Example A-3 Aqueous coating material 3 | Comparative Example A-1 Aqueous coating material 4 | Comparative Example A-2 Aqueous coating material 5 | Comparative Example A-3 Aqueous coating material 6 | Comparative Example A-4 Aqueous coating material 7 | Comparative Example A-5 Aqueous coating material 3 | Comparative Example A-6 Aqueous coating material 3 |
| 0 | 25 | 0.08 | 0.04 | 0.08 | 0.12 | 0.12 | 0.01 | 0.02 | 0.08 | 0.08 |
| 2 | 25 | 0.04 | 0.04 | 0.07 | 0.12 | 0.12 | 0.02 | 0.02 | 0.07 | 0.07 |
| 5 | 25 | 0.04 | 0.06 | 0.04 | 0.07 | 0.07 | 0.04 | 0.02 | 0.04 | 0.04 |
| 10 | 25 | 0.02 | 0.04 | 0.07 | 0.06 | 0.06 | 0.07 | 0.02 | 0.07 | 0.07 |

TABLE 3-continued

| Time [min] | Temperature [° C.] | Reciprocal of average value of viscosities [(Pa · s)$^{-1}$] | | | | | | | | |
|---|---|---|---|---|---|---|---|---|---|---|
| | | Example A-1 Aqueous coating material 1 | Example A-2 Aqueous coating material 2 | Example A-3 Aqueous coating material 3 | Comparative Example A-1 Aqueous coating material 4 | Comparative Example A-2 Aqueous coating material 5 | Comparative Example A-3 Aqueous coating material 6 | Comparative Example A-4 Aqueous coating material 7 | Comparative Example A-5 Aqueous coating material 3 | Comparative Example A-6 Aqueous coating material 3 |
| 13 | 80 | 0.03 | 0.03 | 0.09 | 0.27 | 0.32 | 0.27 | 0.02 | 0.09 | — |
| 20 | 80 | — | — | — | — | — | — | — | 0.08 | — |

TABLE 4

| Time [min] | Temperature [° C.] | Time integration value of reciprocal of average value of viscosities [(Pa · s)$^{-1}$ · min] | | | | | | | | |
|---|---|---|---|---|---|---|---|---|---|---|
| | | Example A-1 Aqueous coating material 1 | Example A-2 Aqueous coating material 2 | Example A-3 Aqueous coating material 3 | Comparative Example A-1 Aqueous coating material 4 | Comparative Example A-2 Aqueous coating material 5 | Comparative Example A-3 Aqueous coating material 6 | Comparative Example A-4 Aqueous coating material 7 | Comparative Example A-5 Aqueous coating material 3 | Comparative Example A-6 Aqueous coating material 3 |
| 0 | 25 | 0 | 0 | 0 | 0 | 0 | 0 | 0 | 0 | 0 |
| 2 | 25 | 0.12 | 0.11 | 0.15 | 0.23 | 0.24 | 0.03 | 0.05 | 0.15 | 0.15 |
| 5 | 25 | 0.24 | 0.26 | 0.32 | 0.51 | 0.51 | 0.12 | 0.12 | 0.32 | 0.32 |
| 10 | 25 | 0.38 | 0.49 | 0.62 | 0.82 | 0.84 | 0.41 | 0.22 | 0.62 | 0.62 |
| 13 | 80 | 0.46 | 0.60 | 0.87 | 1.31 | 1.42 | 0.92 | 0.28 | 0.87 | — |
| 20 | 80 | — | — | — | — | — | — | — | 1.49 | — |

TABLE 5

| Time [min] | Temperature [° C.] | Time integration value of reciprocal of average value of viscosities [(Pa · s)$^{-1}$ · min] | | | | | | | | |
|---|---|---|---|---|---|---|---|---|---|---|
| | | Example A-1 Aqueous coating material 1 | Example A-2 Aqueous coating material 2 | Example A-3 Aqueous coating material 3 | Comparative Example A-1 Aqueous coating material 4 | Comparative Example A-2 Aqueous coating material 5 | Comparative Example A-3 Aqueous coating material 6 | Comparative Example A-4 Aqueous coating material 7 | Comparative Example A-5 Aqueous coating material 3 | Comparative Example A-6 Aqueous coating material 3 |
| 0 | 25 | 51.1 | 56.3 | 51.7 | 56.3 | 61.0 | 52.7 | 53.2 | 51.8 | 51.5 |
| 2 | 25 | 51.1 | 58.8 | 52.4 | 58.5 | 68.3 | 56.5 | 54.5 | 52.6 | 52.5 |
| 5 | 25 | 53.3 | 63.2 | 55.3 | 62.9 | 71.8 | 59.7 | 57.4 | 55.5 | 55.4 |
| 10 | 25 | 57.9 | 68.0 | 60.9 | 64.3 | 76.7 | 63.1 | 60.0 | 61.1 | 61.5 |
| 13 | 80 | 91.1 | 93.8 | 90.7 | 88.9 | 92.7 | 91.0 | 90.9 | 90.8 | — |
| 20 | 80 | — | — | — | — | — | — | — | 94.5 | — |

TABLE 6

| | Example A-1 Aqueous coating material 1 | Example A-2 Aqueous coating material 2 | Example A-3 Aqueous coating material 3 | Comparative Example A-1 Aqueous coating material 4 | Comparative Example A-2 Aqueous coating material 5 | Comparative Example A-3 Aqueous coating material 6 | Comparative Example A-4 Aqueous coating material 7 | Comparative Example A-5 Aqueous coating material 3 | Comparative Example A-6 Aqueous coating material 3 |
|---|---|---|---|---|---|---|---|---|---|
| Time integration value of reciprocal of average value of viscosities at completion of drying [Pa · s]$^{-1}$ · min] | 0.46 | 0.60 | 0.87 | 1.31 | 1.42 | 0.92 | 0.28 | 1.49 | 0.62 |
| Solid content concentration at completion of drying [% by mass] | 91.1 | 93.8 | 90.7 | 88.9 | 92.7 | 91.0 | 90.9 | 94.5 | 61.5 |
| Average value of viscosities before start of drying (time of 0 min) [Pa · s] | 13.2 | 15.7 | 12.5 | 8.5 | 8.5 | 121.3 | 40.3 | 12.6 | 12.5 |

TABLE 6-continued

| | Example A-1 Aqueous coating material 1 | Example A-2 Aqueous coating material 2 | Example A-3 Aqueous coating material 3 | Comparative Example A-1 Aqueous coating material 4 | Comparative Example A-2 Aqueous coating material 5 | Comparative Example A-3 Aqueous coating material 6 | Comparative Example A-4 Aqueous coating material 7 | Comparative Example A-5 Aqueous coating material 3 | Comparative Example A-6 Aqueous coating material 3 |
|---|---|---|---|---|---|---|---|---|---|
| Sagging property (80° C.) | Not found | Not found | Not found | Found | Found | Found | Not found | Found | Not found |
| Wd | 34.5 | 31.2 | 23.2 | Impossible to measure | Impossible to measure | Impossible to measure | 45.9 | Impossible to measure | Impossible to measure |

As listed in Table 6, it was found that in a case where the wet coating film was dried and irradiated with electron beams until the time integration value of the reciprocal of the average value of the viscosities of the surface layer region of the wet coating film was in a range of 0.30 $(Pa\cdot s)^{-1}\cdot min$ to 0.90 $(Pa\cdot s)^{-1}\cdot min$ and the solid content concentration of the wet coating film was 90% by mass or greater (Examples A-1 to A-3), sagging did not occur during drying of the wet coating film, the Wd value was 40 or less, and both suppression of sagging and improvement of smoothness of the surface of the coating film were able to be achieved.

Meanwhile, in a case where the wet coating film was irradiated with electron beams after the time integration value of the reciprocal of the average value of the viscosities of the surface layer region exceeded 0.90 $(Pa\cdot s)^{-1}\cdot min$ (Comparative Examples A-1 to A-3 and A-5), sagging occurred during drying of the wet coating film, and the Wd value was also difficult to measure. Particularly, it was found that in Comparative Example A-5, the time integration value of the reciprocal of the average value of the viscosities of the surface layer region exceeded 0.90 $(Pa\cdot s)^{-1}\cdot min$ and sagging occurred during drying of the wet coating film by increasing the heating time at 80° C. by 7 minutes, as compared with Example A-3. Further, in a case where the wet coating film was irradiated with electron beams before the time integration value of the reciprocal of the average value of the viscosities of the surface layer region reached 0.30 $(Pa\cdot s)^{-1}\cdot min$ (Comparative Example A-4), sagging did not occur during drying of the wet coating film, the Wd value exceeded 40, and the obtained cured coating film had a poor appearance (particularly, the appearance as an automobile coating film). Further, in Comparative Example A-6, the time integration value of the reciprocal of the average value of the viscosities of the surface layer region was in a range of 0.30 $(Pa\cdot s)^{-1}\cdot min$ to 0.90 $(Pa\cdot s)^{-1}\cdot min$, but the wet coating film was not dried until the solid content concentration of the wet coating film reached 90% by mass because the wet coating film was not heated to 80° C. Therefore, a large amount of volatile components such as water remained in the obtained dry coating film, the cured coating film was in a sponge-like state, and thus the appearance of the coating film was not able to be accurately evaluated.

Example B-1

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example A-1 except that the obtained wet coating film was rapidly held at 25° C. for 30 minutes after the application of the aqueous coating material 1 and was not heated to 80° C. The results are listed in Tables 7 to 10.

Further, the cured coating film was prepared on an electrodeposition coating plate, the sagging property of the obtained cured coating film was confirmed, and the wave scan value (Wd) of the cured coating film was measured in the same manner as in Example A-1 except that the obtained wet coating film was rapidly held at 25° C. for 30 minutes after the application of the aqueous coating material 1 and was not heated to 80° C. The results are listed in Table 11. Further, the drying conditions were set based on the results listed in Tables 9 and 10.

Example B-2

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example B-1 except that the aqueous coating material 2 obtained in Preparation Example 2 was used in place of the aqueous coating material 1. The results are listed in Tables 7 to 10.

Further, the cured coating film was prepared on an electrodeposition coating plate, the sagging property of the obtained cured coating film was confirmed, and the wave scan value (Wd) of the cured coating film was measured in the same manner as in Example B-1 except that the aqueous coating material 2 obtained in Preparation Example 2 was used in place of the aqueous coating material 1. The results are listed in Table 11.

Example B-3

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example B-1 except that the aqueous coating material 3 obtained in Preparation Example 3 was used in place of the aqueous coating material 1. The results are listed in Tables 7 to 10.

Further, the cured coating film was prepared on an electrodeposition coating plate, the sagging property of the obtained cured coating film was confirmed, and the wave scan value (Wd) of the cured coating film was measured in the same manner as in Example B-1 except that the aqueous coating material 3 obtained in Preparation Example 3 was used in place of the aqueous coating material 1. The results are listed in Table 11.

Comparative Example B-1

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example B-1 except that the aqueous coating material 4 obtained in Preparation Example 4 was used in place of the aqueous coating material 1. The results are listed in Tables 7 to 10.

Further, the cured coating film was prepared on an electrodeposition coating plate, the sagging property of the obtained cured coating film was confirmed, and the wave scan value (Wd) of the cured coating film was measured in the same manner as in Example B-1 except that the aqueous coating material 4 obtained in Preparation Example 4 was used in place of the aqueous coating material 1. The results are listed in Table 11.

Comparative Example B-2

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example B-1 except that the aqueous coating material 5 obtained in Preparation Example 5 was used in place of the aqueous coating material 1. The results are listed in Tables 7 to 10.

Further, the cured coating film was prepared on an electrodeposition coating plate, the sagging property of the obtained cured coating film was confirmed, and the wave scan value (Wd) of the cured coating film was measured in the same manner as in Example B-1 except that the aqueous coating material 5 obtained in Preparation Example 5 was used in place of the aqueous coating material 1. The results are listed in Table 11.

Comparative Example B-3

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example B-1 except that the aqueous coating material 6 obtained in Preparation Example 6 was used in place of the aqueous coating material 1. The results are listed in Tables 7 to 10.

Further, the cured coating film was prepared on an electrodeposition coating plate, the sagging property of the obtained cured coating film was confirmed, and the wave scan value (Wd) of the cured coating film was measured in the same manner as in Example B-1 except that the aqueous coating material 6 obtained in Preparation Example 6 was used in place of the aqueous coating material 1. The results are listed in Table 11.

Comparative Example B-4

The average value η of the viscosities of the surface layer region of the wet coating film, the reciprocal 1/η of the average value of the viscosities of the surface layer region of the wet coating film, the time integration value of the reciprocal of the average value of the viscosities of the surface layer region of the wet coating film, and the solid content concentration of the wet coating film at each measurement time were respectively acquired in the same manner as in Example B-1 except that the aqueous coating material 7 obtained in Preparation Example 7 was used in place of the aqueous coating material 1. The results are listed in Tables 7 to 10.

Further, the cured coating film was prepared on an electrodeposition coating plate, the sagging property of the obtained cured coating film was confirmed, and the wave scan value (Wd) of the cured coating film was measured in the same manner as in Example B-1 except that the aqueous coating material 7 obtained in Preparation Example 7 was used in place of the aqueous coating material 1. The results are listed in Table 11.

TABLE 7

| | | Average value [Pa · s] | | | | | | |
|---|---|---|---|---|---|---|---|---|
| Time [min] | Temperature [° C.] | Example B-1 Aqueous coating material 1 | Example B-2 Aqueous coating material 2 | Example B-3 Aqueous coating material 3 | Comparative Example B-1 Aqueous coating material 4 | Comparative Example B-2 Aqueous coating material 5 | Comparative Example B-3 Aqueous coating material 6 | Comparative Example B-4 Aqueous coating material 7 |
| 0 | 25 | 16.6 | 22.0 | 12.4 | 11.6 | 9.2 | 111.5 | 51.5 |
| 2 | 25 | 23.0 | 16.1 | 11.6 | 8.6 | 8.5 | 56.1 | 53.8 |
| 5 | 25 | 28.1 | 27.1 | 19.3 | 15.3 | 14.9 | 23.0 | 74.4 |
| 10 | 25 | 96.5 | 100.5 | 89.8 | 17.0 | 15.7 | 13.9 | 134.2 |
| 30 | 25 | 135.6 | 129.8 | 96.5 | 12.4 | 12.4 | 12.4 | 150.3 |

TABLE 8

| Time [min] | Temperature [° C.] | Reciprocal of average value of viscosities [(Pa · s)$^{-1}$] | | | | | | |
|---|---|---|---|---|---|---|---|---|
| | | Example B-1 Aqueous coating material 1 | Example B-2 Aqueous coating material 2 | Example B-3 Aqueous coating material 3 | Comparative Example B-1 Aqueous coating material 4 | Comparative Example B-2 Aqueous coating material 5 | Comparative Example B-3 Aqueous coating material 6 | Comparative Example B-4 Aqueous coating material 7 |
| 0 | 25 | 0.06 | 0.05 | 0.08 | 0.09 | 0.11 | 0.01 | 0.02 |
| 2 | 25 | 0.04 | 0.06 | 0.09 | 0.12 | 0.12 | 0.02 | 0.02 |
| 5 | 25 | 0.04 | 0.04 | 0.05 | 0.07 | 0.07 | 0.04 | 0.01 |
| 10 | 25 | 0.01 | 0.01 | 0.01 | 0.06 | 0.06 | 0.07 | 0.01 |
| 30 | 25 | 0.01 | 0.01 | 0.01 | 0.08 | 0.08 | 0.08 | 0.01 |

TABLE 9

| Time [min] | Temperature [° C.] | Time integration value of reciprocal of average value of viscosities [(Pa · s)$^{-1}$ · min] | | | | | | |
|---|---|---|---|---|---|---|---|---|
| | | Example B-1 Aqueous coating material 1 | Example B-2 Aqueous coating material 2 | Example B-3 Aqueous coating material 3 | Comparative Example B-1 Aqueous coating material 4 | Comparative Example B-2 Aqueous coating material 5 | Comparative Example B-3 Aqueous coating material 6 | Comparative Example B-4 Aqueous coating material 7 |
| 0 | 25 | 0 | 0 | 0 | 0 | 0 | 0 | 0 |
| 2 | 25 | 0.10 | 0.11 | 0.17 | 0.20 | 0.23 | 0.03 | 0.04 |
| 5 | 25 | 0.22 | 0.26 | 0.37 | 0.47 | 0.50 | 0.12 | 0.09 |
| 10 | 25 | 0.34 | 0.37 | 0.53 | 0.79 | 0.83 | 0.41 | 0.14 |
| 13 | 25 | 0.51 | 0.55 | 0.75 | 2.18 | 2.28 | 1.93 | 0.28 |

TABLE 10

| Time [min] | Temperature [° C.] | Solid content concentration [% by mass] | | | | | | |
|---|---|---|---|---|---|---|---|---|
| | | Example B-1 Aqueous coating material 1 | Example B-2 Aqueous coating material 2 | Example B-3 Aqueous coating material 3 | Comparative Example B-1 Aqueous coating material 4 | Comparative Example B-2 Aqueous coating material 5 | Comparative Example B-3 Aqueous coating material 6 | Comparative Example B-4 Aqueous coating material 7 |
| 0 | 25 | 51.1 | 56.3 | 52.1 | 57.5 | 61.0 | 52.9 | 53.3 |
| 2 | 25 | 51.5 | 59.1 | 53.3 | 58.4 | 68.9 | 56.6 | 54.6 |
| 5 | 25 | 53.3 | 63.2 | 55.5 | 62.9 | 71.9 | 60.0 | 57.5 |
| 10 | 25 | 57.9 | 68.2 | 61.2 | 64.5 | 76.8 | 63.2 | 60.5 |
| 13 | 25 | 91.9 | 94.5 | 91.1 | 89.5 | 93.5 | 91.3 | 92.1 |

TABLE 11

| | Example B-1 Aqueous coating material 1 | Example B-2 Aqueous coating material 2 | Example B-3 Aqueous coating material 3 | Comparative Example B-1 Aqueous coating material 4 | Comparative Example B-2 Aqueous coating material 5 | Comparative Example B-3 Aqueous coating material 6 | Comparative Example B-4 Aqueous coating material 7 |
|---|---|---|---|---|---|---|---|
| Time integration value of reciprocal of average value of viscosities at completion of drying [Pa · s]$^{-1}$ · min] | 0.51 | 0.55 | 0.75 | 2.18 | 2.28 | 1.93 | 0.28 |
| Solid content concentration at completion of drying [% by mass] | 91.9 | 94.5 | 91.1 | 89.5 | 93.5 | 91.3 | 92.1 |

TABLE 11-continued

| | Example B-1 Aqueous coating material 1 | Example B-2 Aqueous coating material 2 | Example B-3 Aqueous coating material 3 | Comparative Example B-1 Aqueous coating material 4 | Comparative Example B-2 Aqueous coating material 5 | Comparative Example B-3 Aqueous coating material 6 | Comparative Example B-4 Aqueous coating material 7 |
|---|---|---|---|---|---|---|---|
| Average value of viscosities before start of drying (time of 0 min) [Pa · s] | 16.6 | 22.0 | 12.4 | 11.6 | 9.2 | 111.5 | 51.5 |
| Sagging property (80° C.) Wd | Not found 35.2 | Not found 33.9 | Not found 24.6 | Found Impossible to measure | Found Impossible to measure | Found Impossible to measure | Not found 42.1 |

As listed in Table 11, in Examples B-1 to B-3, it was found that even in a case where the wet coating film was dried at a low temperature (25° C.), sagging did not occur during drying of the wet coating film, the Wd value was 40 or less, and both suppression of sagging and improvement of smoothness of the surface of the coating film were able to be achieved by irradiating the wet coating film with electron beams after the wet coating film was dried until the time integration value of the reciprocal of the average value of the viscosities of the surface layer region was in a range of 0.30 $(Pa\cdot s)^{-1}\cdot min$ to 0.90 $(Pa\cdot s)^{-1}\cdot min$ and the solid content concentration of the wet coating film was 90% by mass or greater.

Meanwhile, in Comparative Examples B-1 to B-3, even in a case where the drying time at 25° C. was more increased as compared to Comparative Examples A-1 to A-3 without heating the wet coating film to 80° C., the time integration value of the reciprocal of the average value of the viscosities of the surface layer region exceeded 0.90 $(Pa\cdot s)^{-1}\cdot min$, and occurrence of sagging during drying of the wet coating film was not able to be suppressed. Further, in Comparative Example B-4, even in a case where the drying time at 25° C. was more increased as compared to Comparative Example A-4 without heating the wet coating film to 80° C., the time integration value of the reciprocal of the average value of the viscosities of the surface layer region did not reach 0.30 $(Pa\cdot s)^{-1}\cdot min$, sagging did not occur during drying of the wet coating film, but the Wd value exceeded 40, and the obtained cured coating film had a poor appearance (particularly, the appearance as an automobile coating film).

Shear Rate Dependence of Viscosity of Coating Film-forming Component

The viscosities of the polyester acrylate (M-7100) serving as a coating film-forming component and pseudoplastic acrylate (M-7100 (RC)) to which pseudoplasticity was imparted by adding 2 parts by mass of a viscosity modifier ("BYK-415" manufactured by Big Chemie Japan Co., Ltd.) to 98 parts by mass of the polyester acrylate (M-7100) were measured under the conditions of a temperature of 25° C. and a shear rate of 0.1 $s^{-}$ to 1000 $s^{-1}$ using a dynamic viscoelasticity measuring device ("ARES-G2", manufactured by TA Instruments, cone plate diameter: 25 mm, cone angle: 0.04°). The results are shown in FIG. 1.

As shown in FIG. 1, it was considered that since in the pseudoplastic acrylate (M-7100 (RC)), the ratio $(\eta_{0.1}/\eta_{1000})$ of the viscosity $(\eta_{0.1})$ of the pseudoplastic acrylate at a shear rate of 0.1 $s^{-1}$ to the viscosity $(\eta_{1000})$ of the pseudoplastic acrylate at a shear rate of 1000 $s^{-1}$ was 7.1, and the pseudoplasticity developed during drying of the wet coating film so that the viscosity of the wet coating film increased, occurrence of sagging during drying of the wet coating film was suppressed in Examples A-1 to A-3 and B-1 to B-3 and Comparative Examples A-4, A-6, and B-4.

On the contrary, it was considered that since in the polyester acrylate (M-7100), the ratio $(\eta_{0.1}/\eta_{1000})$ of the viscosity $(\eta_{0.1})$ of the polyester acrylate at a shear rate of 0.1 $s^{-1}$ to the viscosity $(\eta_{1000})$ of the polyester acrylate at a shear rate of 1000 $s^{-1}$ was less than 5 and the behavior extremely close to Newtonian behavior was shown, the viscosity did not increase during drying of the wet coating film, and occurrence of sagging during drying of the wet coating film was not able to be suppressed in Comparative Examples A-1 to A-3 and Comparative Examples B-1 to B-3.

As described above, according to the embodiment of the present disclosure, it is possible to suppress occurrence of sagging during drying and to form a cured coating film having excellent surface smoothness. Therefore, the method of applying the electron beam curable aqueous coating material according to the embodiment of the present disclosure is useful as a coating method for coating bodies that request a high level of appearance quality, particularly, automobile bodies, such as passenger cars, trucks, buses, and motorcycles, and components of the automobile bodies.

What is claimed is:

1. A method of applying an electron beam curable aqueous coating material, the method comprising:

coating a surface of a material to be coated with the electron beam curable aqueous coating material to form a wet coating film, the electron beam curable aqueous coating material including a coating film-forming component including an ethylenically unsaturated compound and a non-aqueous viscosity modifier including butyl cellosolve or isopropyl alcohol;

drying the wet coating film to obtain a dry coating film until a time integration value of a reciprocal of an average value of viscosities of a region from a surface of the wet coating film to a depth of one half a film thickness of the wet coating film is in a range of 0.30 $(Pa\cdot S)^{-1}\cdot min$ to 0.90 $(Pa\cdot S)^{-1}\cdot min$, which is acquired by an electric field pick-up method, and a solid content concentration of the wet coating film is 90% by mass or greater; and curing the obtained dry coating film by irradiation with an electron beam after the wet coating film is dried.

2. The method according to claim 1, wherein the average value of the viscosities of the region from the surface of the wet coating film before start of drying to the depth of one half the film thickness of the wet coating film, which is acquired by the electric field pick-up method, is in a range of 10 Pa·s to 100 Pa·s.

3. The method according to claim 1, further comprising: mixing the non-aqueous viscosity modifier with the coating film-forming component of the electron beam curable aqueous coating material before application of the electron beam curable aqueous coating material and adjusting a ratio between a viscosity of a mixture of the coating film-forming component and the non-aqueous viscosity modifier at a shear rate of 0.1 $s^{-1}$ and the viscosity of the mixture at a shear rate of 1000 $s^{-1}$, which are measured at a temperature of 25° C., to 5 or greater.

4. The method according to claim 1, wherein the non-aqueous viscosity modifier includes the butyl cellosolve.

5. The method according to claim 1, wherein the non-aqueous viscosity modifier includes the isopropyl alcohol.

6. The method according to claim 1, wherein the electron beam curable aqueous coating material contains the non-aqueous viscosity modifier in a range of 1 part by mass to 3 parts by mass with respect to 100 parts by mass of the coating film-forming component.

7. The method according to claim 1, wherein an amount of water in the electron beam curable aqueous coating material is 40 to 50 parts by mass.

* * * * *